US005947585A

United States Patent [19]

Hill

[11] Patent Number: 5,947,585

[45] Date of Patent: Sep. 7, 1999

[54] HEATED COVER FOR FLASHLIGHT USED IN COLD WEATHER

[76] Inventor: Stephen C. Hill, 14066 Landings Way, Fenton, Mich. 48430

[21] Appl. No.: 08/942,228

[22] Filed: Oct. 1, 1997

Related U.S. Application Data

[60] Provisional application No. 60/027,917, Oct. 11, 1996.

[51] Int. Cl.[6] ..... F21L 7/00

[52] U.S. Cl. ..... 362/208; 362/253; 362/189; 219/220; 219/228; 219/230; 219/236

[58] Field of Search ..... 362/253, 189, 362/208; 219/220, 228, 230, 236

[56] References Cited

U.S. PATENT DOCUMENTS

| | | | |
|---|---|---|---|
| 744,739 | 11/1903 | Fliess | 219/201 |
| 3,667,315 | 6/1972 | Polly, Sr. | 74/551.8 |
| 3,710,092 | 1/1973 | Olbermann, Jr. | 240/6.4 |
| 3,973,422 | 8/1976 | Cervera | 70/431 |
| 4,034,489 | 7/1977 | Hughes, Jr. | 37/16 |
| 4,415,954 | 11/1983 | Schaefer | 362/202 |
| 4,598,192 | 7/1986 | Garrett | 219/201 |
| 4,883,942 | 11/1989 | Robak, Sr. et al. | 219/227 |
| 5,016,148 | 5/1991 | Kohm | 362/102 |
| 5,188,450 | 2/1993 | Anderson | 362/194 |
| 5,306,287 | 4/1994 | Becker | 606/205 |
| 5,735,037 | 4/1998 | Ogata | 29/611 |

*Primary Examiner*—Sandra O'Shea
*Assistant Examiner*—Ronald E. DelGizzi
*Attorney, Agent, or Firm*—Gifford, Krass, Groh, Sprinkle, Anderson & Citkowski, P.C.

[57] ABSTRACT

A cover for a flashlight handle comprising at least one heating coil positioned proximate to the handle so that heat generated by the heating coil warms the area gripped by a user. In the preferred embodiment, the heating coil is disposed within a flexible sleeve which is attached to the flashlight handle so that at least a portion of the flashlight handle is disposed within the flexible sleeve. A power source is preferably disposed within the flashlight handle. A switch in electrical communication with the power source and the heating coil is operative to enable a user to providing power to the heating coils.

4 Claims, 1 Drawing Sheet

HEATED COVER FOR FLASHLIGHT USED IN COLD WEATHER

This application claims the benefit of U.S. provisional application having Ser. No. 60/027,917 filed on Oct. 11, 1996 entitled "Flashlight Cover."

FIELD OF THE INVENTION

This invention relates generally to flashlights, and more particularly to a flashlight having a cover attached thereto.

BACKGROUND OF THE INVENTION

In many cold weather situations, it is imperative that hand held flashlights be utilized. Flashlights, and especially metal flashlights, tend to become very cold during cold weather and, if they are handled while cold, they can cause discomfort to the user. Policeman, fireman and others who use flashlights in cold weather climates must suffer the discomfort caused by the effects of cold flashlights. If the climate is cold enough and the flashlights are handled without gloves or for extended periods of time, frostbite of the fingers and hands can result.

While an abundance of flashlights is available which have been particularly configured for a variety of specific uses, there remains a need for a flashlight which enables a user to hold the flashlight without suffering from the effects of cold weather on the flashlight.

SUMMARY OF THE INVENTION

The present invention provides a means for overcoming this problem by providing a heated cover for a flashlight, the cover comprising a flexible sleeve having an exterior surface. The flexible sleeve is attached to the flashlight handle so that at least a portion of the flashlight handle is disposed within the flexible sleeve. At least one heating coil is disposed within the flexible sleeve. A power source, preferably batteries, is in electrical communication with the heating coil, the batteries being preferably disposed within the flashlight handle. When power is provided to the heating coil, the heating coil warms the exterior surface of the flexible sleeve. A switch in electrical communication with the power source and the heating coil is operative to enable a user to illuminate the flashlight with or without providing power to the heating coils.

Other objects, advantages and applications of the present invention will be made clear by the following detailed description of a preferred embodiment of the invention. The description makes references to drawings in which:

DETAILED DESCRIPTION

Figure 1:
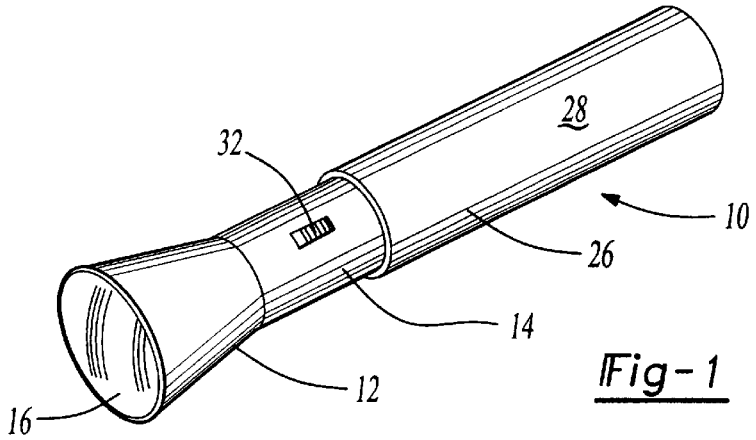
FIG. 1 is a perspective view of the cover and flashlight.
Figure 2:
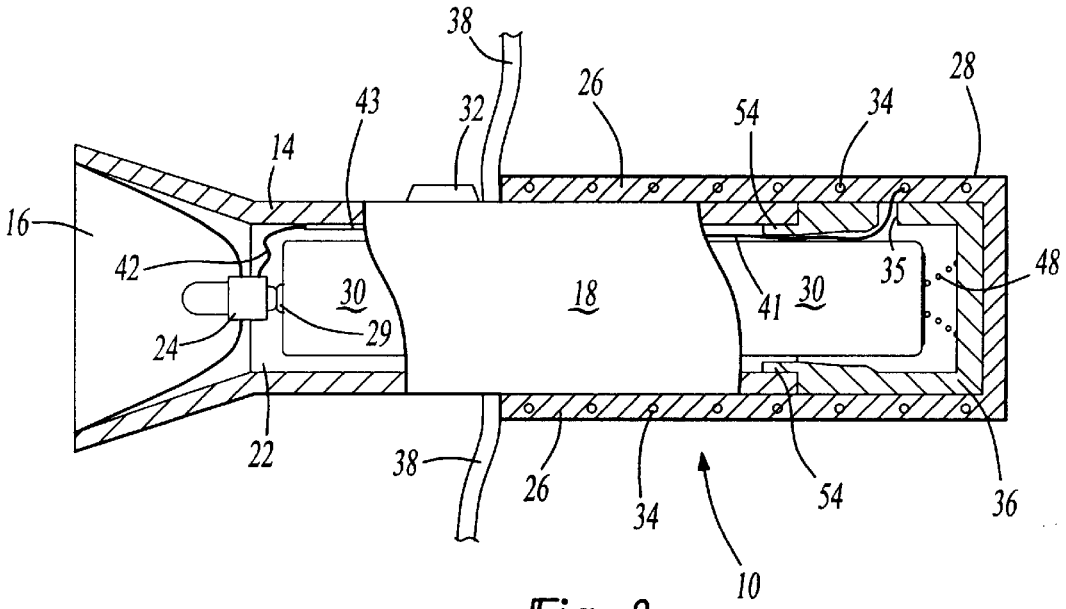
FIG. 2 is a cross-sectional view of the embodiment depicted in FIG. 1.

In the preferred embodiment depicted in FIG. 1, a cover 10 is disposed to cover a portion of a flashlight 12 having a handle 14. The cover 10 preferably includes a flexible sleeve 26 having an exterior surface 28 which is preferably configured to be gripped by a user and which encircles at least a portion of the handle 14. As best seen in FIG. 2, at least one heating coil 34 is disposed within the flexible sleeve 26 which is operative to heat the flexible sleeve 26. By gripping the flexible sleeve 26 which has been heated by the heating coil 34, a user may hold and operate the flashlight 12 in extremely cold weather without coming into direct contact with the flashlight handle 14 and without suffering from cold hands. The flashlight 12 is of a conventional construction and the cover 10 may be configured for use with any hand-held flashlight.

A partial cross-sectional view of the flashlight 12 is shown in FIG. 2, the flashlight 12 having a first end 16, a second end 18, and an internal cavity 22. Disposed within the internal cavity 22 of the flashlight 12 is a light source or lamp 24 which is in electrical communication with a power source such as batteries 30. The batteries 30, the light source 24 and the switch 32 are electrically connected by way of a terminal 43, a wire 42 and battery posts 29 in any of a variety of conventional configurations which enable the light source 24 to be turned on and off by an actuating switch 32.

The heating coils 34 are in electrical communication with at least one of the batteries 30 and the switch 32 by way of a wire 41. The switch 32 is preferably operative to enable a user to operate the light source 24 and the heating coil 34 independently or simultaneously. A variety of switch configurations may be utilized, such switch configurations being within the skill of the ordinary artisan.

When the switch 32 is in the "on" position with respect to the heating coil 34, the heating coil draws power from the batteries 30 to warm the flexible sleeve 26. Thus, a user grasping the exterior surface 28 feels the warmth generated by the heating coil 34 through the flexible sleeve 26.

The flexible sleeve 26 may be attached to the flashlight handle 14 in a variety of ways. The sleeve 26 may be retained on the handle 14 by a strap 38, hook and loop fasteners such as Velcro, or by an adhesive. Alternately, the sleeve 26 may be attached to a housing 36 which is in engagement with the second end 18 of the flashlight handle 14. A housing 36 can replace an end cap which is ordinarily provided in flashlights having a conventional construction. Upon engagement of the housing 36 with the end 18 of the flashlight handle 14, the sleeve preferably has sufficient rigidity to remain in place along the handle 14 of the flashlight 12.

A spring 48 preferably is utilized to force the batteries 30 into engagement with the system of terminals and wires utilized to connect the batteries 30 to the light source 24 and the switch 32. The housing 36 may be attached to the end 18 of the flashlight handle 14 in a variety of ways, including by spring arms 54 which may be integrally molded into the housing 36.

Preferably, the flexible sleeve 26 is constructed of a fabric or similar material which transfers and helps to retain the heat generated by the heating coil 34. The sleeve 28 may be made of a stretchable, resilient material which may be expanded to slide over the handle 14 and, upon release, contract so as to closely grip the flashlight handle 14 thus retaining the flexible sleeve 26 in position without necessitating any additional attachment mechanisms.

Although the cover of the present invention preferably utilizes the heating coil 34 disposed within the sleeve 26, a variety of other means may be utilized within the sleeve 26 to warm the exterior of the sleeve 26.

Figure 3:
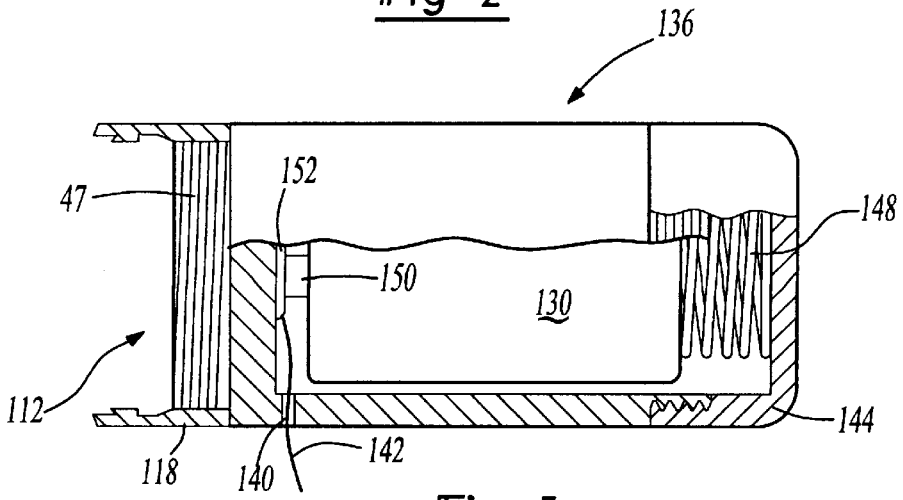
FIG. 3 is a partial cross-sectional view of an alternate embodiment of the present invention.

FIG. 3 depicts an alternate embodiment of the present invention wherein the power source for the cover is not in electrical communication with the power source for the flashlight 12. A compartment for a battery 130 is provided within the housing 136. The housing 136 has a threaded end

47 which is threadably received within a threaded end 118 of a flashlight 112. The battery 130 disposed within the housing 136 is in electrical communication with the heating coil 34 disposed in the sleeve 26 (not shown in FIG. 3) by way of wires 142 passing through an opening 140 provided in the housing 136. The sleeve 26 may be mechanically attached to the housing 136 in any manner such as by a strap or an adhesive and extends over the exterior handle portion of the flashlight 112. A switch (also not shown in FIG. 3) is provided which only activates and deactivates the heating coil 34 disposed within the sleeve 26. An end cap 144 is threadably received on an end of the housing 136 to allow access to the battery 130.

A spring 148 urges a terminal 150 of the battery 130 into engagement with an electrical contact 152 which is electrically connected to the wire 142.

Although several preferred embodiments of the present invention have been disclosed, it should be apparent that modifications can be made to the embodiments shown without departing from the spirit of the invention.

I claim:

1. A flashlight comprising:

a housing;

a power source disposed within said housing;

a switch in electrical communication with said power source;

at least one heating coil positioned to surround said housing and said power source so that heat generated by said heating coil warms at least a portion of said housing, said heating coil being in electrical communication with said power source and said switch; and;

a flexible sleeve, said heating coil being disposed within said sleeve, said sleeve being operative to at least partially cover said housing.

2. A cover for a flashlight handle, said cover comprising:

a flexible sleeve;

at least one heating coil disposed within said sleeve;

means for attaching said sleeve to said flashlight handle so that at least a portion of said flashlight handle is disposed within said sleeve;

a power source disposed within and being in electrical communication with said heating coil; and a switch in electrical communication with said power source and said heating coil.

3. The cover of claim 2 further comprising a second housing, said second housing being attachable to the end of said flashlight handle, and said power source being disposed in said second housing.

4. A flashlight comprising:

a first housing supporting a lamp and a first power source;

a second housing supporting a second power source;

means holding said first and second housings in proximity to each other;

a flexible sleeve covering at least a portion of said first and second housings;

a heating coil within said sleeve; and a first switch in electrical communication with said first power source and said lamp and a second switch in electrical communication with said second power source and said heating coil, said first and second switches are operable independently of each other to actuate said lamp and heating coil independently of each other.

* * * * *

UNITED STATES PATENT AND TRADEMARK OFFICE

CERTIFICATE OF CORRECTION

PATENT NO. : 5,947,585

DATED : September 7, 1999

INVENTOR(S) : Stephen C. Hill

It is certified that error appears in the above-identified patent and that said Letters Patent are hereby corrected as shown below:

Column 4, line 21, after "means" and before "holding", insert --for--.

Signed and Sealed this

Twenty-seventh Day of June, 2000

*Attest:*

*Attesting Officer*

Q. TODD DICKINSON

*Director of Patents and Trademarks*